United States Patent [19]

Stelck

[11] 4,349,198

[45] Sep. 14, 1982

[54] STRING FOR SPORTING GOODS

[76] Inventor: Larry W. Stelck, 116 Easy Street Ct., Edmond, Okla. 73034

[21] Appl. No.: 214,188

[22] Filed: Dec. 8, 1980

[51] Int. Cl.[3] ..... A63B 51/02

[52] U.S. Cl. ..... 273/73 D; 428/399

[58] Field of Search ..... 273/73 D, 29 A, 30; 57/234; 428/399, 400

[56] References Cited

U.S. PATENT DOCUMENTS

| | | | |
|---|---|---|---|
| 763,059 | 6/1904 | Hyde | 273/73 D |
| 2,887,132 | 5/1959 | Manning et al. | 428/399 X |
| 3,023,483 | 3/1962 | Steiner | 273/73 D X |
| 3,180,785 | 4/1965 | Thompson | 428/400 X |
| 3,738,096 | 6/1973 | Crandall | 273/73 D X |
| 3,926,431 | 12/1975 | DeLorean | 273/73 D |
| 3,968,967 | 7/1976 | Nally | 273/30 X |
| 4,005,863 | 2/1977 | Henry | 273/73 D |
| 4,026,551 | 5/1977 | Larson | 273/29 A X |
| 4,095,790 | 6/1978 | Swiecicki | 273/73 D |
| 4,238,262 | 12/1980 | Fishel | 273/73 D X |
| 4,249,731 | 2/1981 | Amster | 273/73 D |

FOREIGN PATENT DOCUMENTS

| | | | |
|---|---|---|---|
| 2633070 | 1/1978 | Fed. Rep. of Germany | 273/73 D |
| 2642978 | 3/1978 | Fed. Rep. of Germany | 273/73 D |

*Primary Examiner*—Richard J. Apley

*Attorney, Agent, or Firm*—E. Harrison Gilbert, III

[57] ABSTRACT

A string comprises an elongated member having a plurality of protuberances extending outwardly therefrom. These protuberances include a first set of protuberances which are disposed along a first perimeter of the elongated member. The plurality of protuberances also includes a second set of protuberances which are disposed along a second perimeter of the elongated member. Each of these protuberances of the second set is offset from each of the protuberances of the first set. In particular, the two sets of protuberances are positioned so that they are substantially parallel to respective radii which are in the opposite set of protuberances and which bisect consecutive ones of the radii with which the protuberances within that opposite set are associated. The line forms an improvement in an article for imparting spin to a ball of the type including a framework having a handle and a hoop extending from one end of the handle.

9 Claims, 3 Drawing Figures

STRING FOR SPORTING GOODS

BACKGROUND OF THE INVENTION

This invention relates to network strings used for sporting goods and more particularly, but not by way of limitation, to line for stringing tennis rackets and the like.

Heretofore, substantially smooth-surfaced materials have been used for stringing tennis rackets and the like. With such smooth-surfaced materials, engagement of a ball or other object by the racket is generally by means of the angular relationship between the racket and the ball and by means of friction between the surface of the string and the surface of the ball. Such smooth-surfaced lines provides little mechanical engagement, other than the frictional engagement, with the ball for assisting in spinning the ball when the string engages the ball.

However, because it is at times advantageous to impart various types of spin to a tennis ball or the like during the playing of a game, for example, there is a need for a suitable string or line which provides or increases the mechanical connection between the ball and the line comprising the network of the racket so that improved spin can be imparted to the ball. Such a mechanical connection is advantageous, for example, in providing top spin to a ball struck by a tennis racket. I do not believe that such an increase in the mechanical connection between a line and an object has been previously achieved in the manner contemplated by my invention.

SUMMARY OF THE INVENTION

The present invention overcomes the above-noted and other shortcomings of the prior art by providing a novel and improved string for sporting goods. This string includes means for mechanically engaging a ball which increases the grip or engagement achieved between the string and the ball to impart improved spin to the ball.

Broadly, the string of the present invention comprises an elongated member or line and a plurality of protuberances extending outwardly therefrom. The inventive string provides an improvement in an article for imparting spin to a ball of the type including a framework having a handle and further having a hoop extendng from one end of the handle. In such an article the inventive string includes a line which has the plurality of protuberances extending therefrom for engaging the ball and which is connected to the hoop in a network.

Therefore, from the foregoing, it is a general object of the present invention to provide a novel and improved string for sporting goods. Other and further objects, features and advantages of the present invention will be readily apparent to those skilled in the art when the following description of the preferred embodiment is read in conjunction with the accompanying drawings.

BRIEF DESCRIPTION OF THE DRAWINGS

FIG. 3 is an illustration of a racket having a network formed of the string constructed in accordance with the preferred embodiment of the present invention.

DETAILED DESCRIPTION OF THE PREFERRED EMBODIMENT OF THE INVENTON

Figure 1:
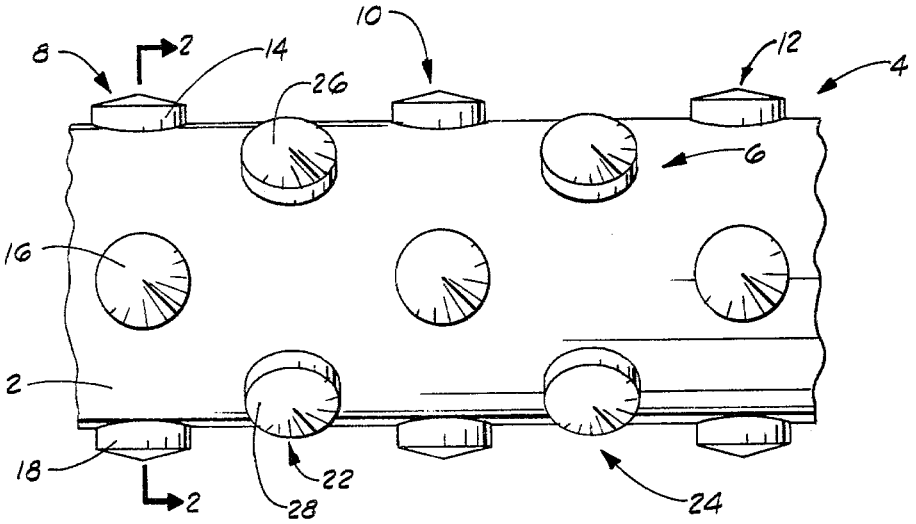
FIG. 1 is a side view of a segment of a string constructed in accordance with a preferred embodiment of the present invention.

With reference to the drawings a description of the preferred embodiment of the present invention will be given. FIG. 1 discloses that the string of the present invention includes an elongated member or line 2 which in the preferred embodiment is a monofilament line made of a suitable substance. Extending outwardly from the line 2 is a plurality of protuberances which are formed integrally from or with the line 2.

In the preferred embodiment the protuberances comprise a first group 4 and a second group 6 of protuberances. The first group 4 of protuberances includes a plurality of sets of protuberances specifically identified in FIG. 1 to include a set 8, another set 10, and a further set 12 of individual protuberances. By way of example, the set 8 of protuberances includes individual protuberances 14, 16, 18 and 20 which, in the preferred embodiment, are formed with a substantially cylindrical base and a substantially conical top.

The individual protuberances 14, 16, 18 and 20 are spaced along a respective perimeter of the elongated member 2. In the preferred embodiment, the elongated member is substantially cylindrically shaped so that the spacing is specifically along a respective circumference of the preferred embodiment elongated member.

Also in the preferred embodiment each individual protuberance extends substantially radially outwardly from the elongated member and has a respective radius of the elongated member associated therewith. The radii associated with consecutive ones of the protuberances (e.g., protuberances 14 and 16 or protuberances 16 and 18) form an angle therebetween.

As will be noted in FIG. 1, each of the sets 8, 10 and 12 of protuberances contained within the first group 4 of the protuberances is aligned with each other along the length of the elongated member 2. In other words, corresponding protuberances within each set of protuberances are colinearly disposed along the side of the elongated member 2.

The second group 6 of protuberances similarly includes a plurality of sets of protuberances. The sets of protuberances shown in FIG. 1 to be within the second group 6 of protuberances are identified by the reference numerals 22 and 24. As with the sets of protuberances in the first group of protuberances, each set in the second group 6 includes individual protuberances such as those identified in FIGS. 1 and 2 by the reference numerals 26, 28, 30 and 32.

The individual protuberances comprising each set of protuberances in the second group 6 are disposed along a respective perimeter of the elongated member 2. Specifically for the cylindrically shaped elongated member 2 shown in the drawings, the disposition of the protuberances 26–32 is circumferentially around the elongated member 2.

Figure 2:
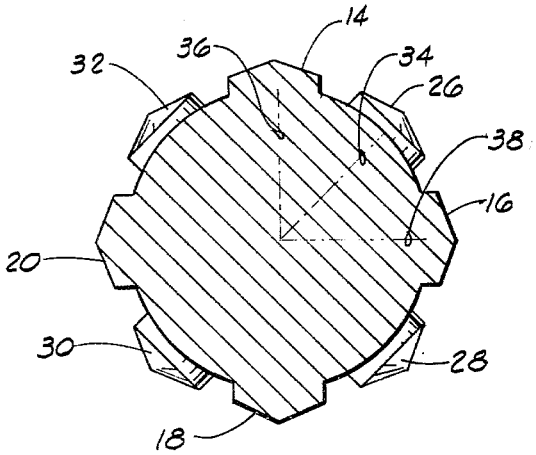
FIG. 2 is a cross-sectional view taken along line 2—2 shown in FIG. 1.
Figure 9:
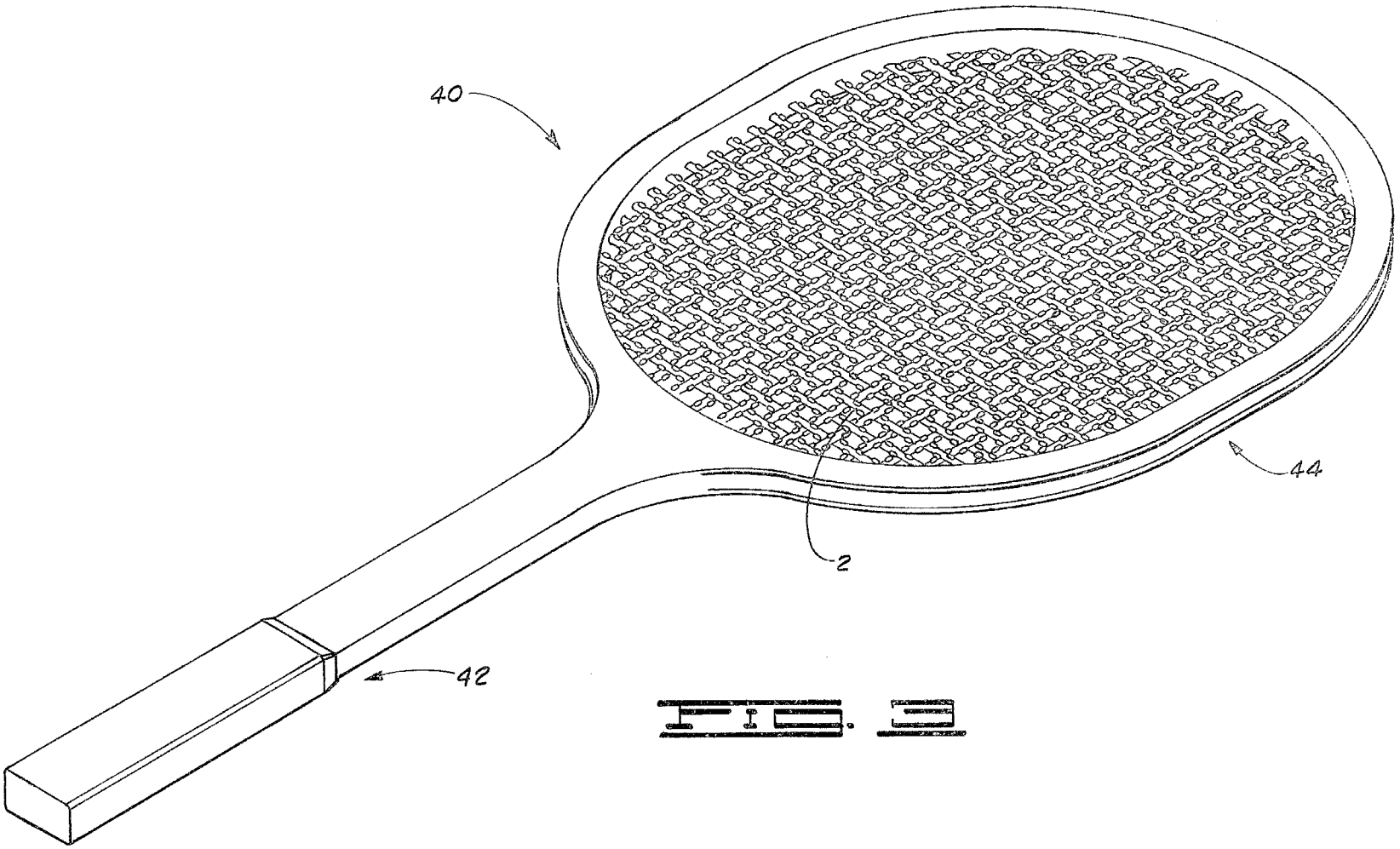

Each protuberance of a particular set of protuberances in the second group 6 is associated with a respective radius which extends to the respective perimeter or circumference of the elongated member. Each such respective radius also extends substantially parallel to a radius extending to the perimeter or circumference of one of the sets of protuberances of the first group 4 and lying between consecutive ones of the respective radii associated with respective protuberances of a respective set of protuberances in the first group 4 of protuberances. For example, the protuberance 26 is shown in FIG. 2 to have a radius 34 associated therewith. The radius 34 extends substantially parallel to a radius which extends to the perimeter of the elongated member 2 with which the first set 8 of protuberances is associated and which lies between a radius 36 and a radius 38 associated with consecutive protuberances 14 and 16. Another way of stating the relationship between each protuberance within the sets of protuberances of the second group 6 of protuberances and each protuberance of each set of the first group 4 of protuberances is that the protuberances of the second group 6 are offset, specifically perimetrically or circumferentially offset, from the protuberances of the first group 4. In the preferred embodiment the radius to which a respective radius of a protuberance of the second group 6 of protuberances is substantially parallel bisects the angle formed by the respective consecutive radii (e.g., radii 36 and 38) associated with respective protuberances of the first set 4 of protuberances.

In the preferred embodiment each perimeter or circumference, along which the protuberances of the individual sets of protuberances within the second group 6 are spaced, lies between consecutive ones of the perimeters along which respective sets of protuberances of the first group 4 are spaced. Additionally, each set of protuberances of the second group 6 of protuberances is aligned with each other set of protuberances of the second group 6 of protuberances along the length of the elongated member 2. In other words, corresponding protuberances in each set of protuberances of the second group 6 are collinearly positioned along the length of the elongated member 2.

By way of a specific example, various dimensions of the elongated member and the protuberances will be given; however, it is to be noted that these dimensions may be varied without departing from the scope of the present invention. Additionally, the shapes of the elongated member 2 and the individual protuberances can be varied and the number of protuberances in each set can also be modified without departing from the scope of the invention.

In the specific embodiment, the elongated member has a diameter of approximately 0.058 inch, and each set of protuberances contains four protuberances spaced circumferentially around the elongated member on a center-to-center spacing of approximately 0.0455 inch.

Each protuberance is approximately 0.015 inch high (i.e., each extends 0.015 inch away from the surface of the elongated member to the apex of the protuberance). As with the other dimensions, the height of the protuberances can vary, but the height is believed to be the most advantageous if it is within the range of approximately 0.005 inch to approximately 0.020 inch. The diameter of the cylindrical wall of the specific embodiment of each protuberance is approximately 0.016 inch.

In the specific embodiment, the preferred spacing between consecutive sets of protuberances within each group of protuberances (e.g., the distance between the set 8 and the set 10 or the distance between the set 22 and the set 24) is approximately 0.0416 inch. Each set of protuberances of the second group is spaced equidistantly between the respective consecutive sets of the first group 4 of protuberances.

To manufacture the specific embodiment of the present invention, it is contemplated to use a monofilament line made of a suitable substance which can be heated and then molded to form each of the protuberances integrally from the elongated member 2.

Once the string of the present invention is made, it can be specifically used to form a network in a racket 40 including a framework having a handle 42 and a hoop 44 extending from one end of the handle as illustrated in FIG. 3. Specifically, the line can be used to string a tennis racket or the like. Because of the protuberances extending from the line, the tennis racket having the inventive line or string will be better able to engage a tennis ball and impart appropriate spin thereto.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A string, comprising:

an elongated member; and a plurality of protuberances extending outwardly from said elongated member, said plurality of protuberances including:

a first set of protuberances disposed along a first perimeter of said elongated member, each protuberance of said first set being associated with a respective radius which extends to said first perimeter of said elongated member; and a second set of protuberances disposed along a second perimeter of said elongated member, each protuberance of said second set being associated with a respective radius which extends to said second perimeter of said elongated member and which extends substantially parallel to a radius extending to said first perimeter and lying between consecutive ones of said respective radii associated with respective protuberances of said first set of protuberances, said radius which extends to said first perimeter and which lies between consecutive ones of said respective radii associated with respective protuberances of said first set of protuberances bisecting an angle formed by said respective radii associated with respective protuberances of said first set of protuberances.

2. In an article for imparting spin to a ball of the type including a framework having a handle and a hoop extending from one end of said handle, the improvement comprising:

a line, connected in a network to said hoop, having a plurality of protuberances extending therefrom for engaging the ball, said plurality of protuberances including:

a first set of protuberances disposed along a first circumference of said line; and a second set of protuberances disposed along a second circumference of said line, each protuberance of said second set being offset from each protuberance of said first set.

3. In an article for imparting spin to a ball of the type including a framework having a handle and a hoop extending from one end of said handle, the improvement comprising:

a line, connected in a network to said hoop, having a plurality of protuberances extending therefrom for engaging the ball, said plurality of protuberances including:

a first set of protuberances disposed along a first circumference of said line, each protuberance of said first set being associated with a respective radius which extends to said first cirference of said line; and a second set of protuberances disposed along a second circumference of said line, each protuberance of said second set being associated with a respective radius which extends to said second circumference of said line and which extends substantially parallel to a radius extending to said first circumference and lying between consecutive ones of said respective radii associated with respective protuberances of said first set of protuberances.

4. The improvement as defined in claim 3, wherein each said radius which extends to said first circumference and which lies between consecutive ones of said respective radii associated with respective protuberances of said first set of protuberances bisects an angle formed by said respective radii associated with respective protuberances of said first set of protuberances.

5. The improvement as defined in claim 4, wherein said protuberances are itegrally formed on said line.

6. In an article for imparting spin to a ball of the type included in a framework having a handle and a hoop extending from one end of said handle, the improvement comprising:

a line, connected in a network to said hoop, having a plurality of protuberances extending therefrom for engaging the ball, said plurality of protuberances including:

a first group of protuberances having a plurality of sets of protuberances, each set of protuberances of said first group of protuberances having individual protuberances spaced along a respective circumference of said line and each set of protuberances of said first group of protuberances being aligned with each other set of protuberances of said first group of protuberances along the length of said line; and a second group of protuberances having a plurality of sets of protuberances, each set of protuberances of said second group of protuberances having individual protuberances spaced along a respective circumference lying between consecutive ones of the circumferences along which respective sets of protuberances of said first group are spaced, and each set of protuberances of said second group of protuberances being aligned with each other set of protuberances of said second group of protuberances along the length of said line.

7. The improvement as defined in claim 6, wherein the aligned protuberances of said second group of protuberances are circumferentially offset from the aligned protuberances of said first group of protuberances.

8. The improvement as defined in claim 7, wherein said protuberances are integrally formed on said line.

9. The improvement as defined in claim 7, wherein the respective circumference with which respective sets of protuberances are associated are spaced along the entire length of said line.

* * * * *